US012478856B2

(12) United States Patent
Polstein et al.

(10) Patent No.: US 12,478,856 B2
(45) Date of Patent: Nov. 25, 2025

(54) PERSONAL PROTECTION GUARD

(71) Applicant: Clearview Systems, LLC, Orlando, FL (US)

(72) Inventors: Matthew Polstein, Orlando, FL (US); Michael Polstein, Orlando, FL (US); Jason Polstein, Orlando, FL (US)

(73) Assignee: Clearview Systems, LLC, Orlando, FL (US)

( * ) Notice: Subject to any disclaimer, the term of this patent is extended or adjusted under 35 U.S.C. 154(b) by 0 days.

(21) Appl. No.: 18/279,630

(22) PCT Filed: Mar. 3, 2022

(86) PCT No.: PCT/US2022/018612
§ 371 (c)(1),
(2) Date: Sep. 1, 2023

(87) PCT Pub. No.: WO2022/187425
PCT Pub. Date: Sep. 9, 2022

(65) Prior Publication Data

US 2025/0083025 A1 Mar. 13, 2025

Related U.S. Application Data

(60) Provisional application No. 63/156,327, filed on Mar. 3, 2021.

(51) Int. Cl.
*A41D 13/05* (2006.01)
*A41D 13/015* (2006.01)
*A63B 71/12* (2006.01)

(52) U.S. Cl.
CPC ..... *A63B 71/12* (2013.01); *A41D 13/015* (2013.01)

(58) Field of Classification Search
CPC ..... A41D 13/0562; A63B 2209/10; A63B 2071/1258
See application file for complete search history.

(56) References Cited

U.S. PATENT DOCUMENTS 4,561,123 A * 12/1985 Hull ..... A41D 13/065 2/24
4,926,883 A 5/1990 Strock
(Continued)

FOREIGN PATENT DOCUMENTS

ES 1209338 U 4/2018
WO WO-2017205861 A1 * 11/2017

OTHER PUBLICATIONS

WIPO, European Patent Office ISA, International Search Report, PCT/US22/18612 (Jun. 20, 2022).
(Continued)

*Primary Examiner* — Tajash D Patel
(74) *Attorney, Agent, or Firm* — Baker Donelson; Carl M Davis, II

(57) ABSTRACT

A personal protection guard having a guard portion and mounting portion. The guard portion has a hard shell and resilient inner. pad. The inner pad includes, a padding layer and an exterior facing fastening layer having a mass of fastening loops. The mounting strip has an adhesive strip layer and an engaging member having a hook layer that cooperates with the mass of fastening loops for attaching the guard portion to the mounting portion. The adhesive strip layer includes a removable release layer that when removed exposes the adhesive substance upon the adhesiver strip layer, for attaching the mounting strip to a portion of a person use of the personal protection guard. The guard portion may also include elastic mounting straps coupled to the opposite side of the shell.

24 Claims, 3 Drawing Sheets

(56) References Cited

U.S. PATENT DOCUMENTS

| | | | | |
|---|---|---|---|---|
| 5,732,412 | A * | 3/1998 | Holden | A41D 13/065 2/23 |
| 6,334,443 | B1 | 1/2002 | Olsen | |
| 7,219,372 | B2 * | 5/2007 | Frieler | A41D 13/065 2/23 |
| 7,381,283 | B2 * | 6/2008 | Lee | H01L 21/4857 156/89.12 |
| 7,389,547 | B1 * | 6/2008 | Wiens | A41D 1/089 2/227 |
| 7,841,018 | B2 * | 11/2010 | Kotoske | A63B 71/08 2/22 |
| 8,505,122 | B1 * | 8/2013 | Green | A41D 13/0156 2/463 |
| 9,883,705 | B1 * | 2/2018 | Do | A41B 13/04 |

OTHER PUBLICATIONS

WIPO, European Patent Office ISA, Written Opinion, PCT/US22/18612 (Jun. 20, 2022).
Clearview Systems, LLC, Chapter II Demand, PCT/US22/18612 (Jan. 16, 2023).
WIPO, European Patent Office IPEA, Written Opinion of the IPEA, PCTUS2022018612 (Jan. 23, 2023).
Clearview Systems, LLC, Formal response to the IPEA (Rule 66.3) , PCT/US22/18612 (Feb. 6, 2023).
WIPO, European Patent Office IPEA, International Preliminary Report on Patentability, PCT/US22/18612 (Jun. 5, 2023).

* cited by examiner

PERSONAL PROTECTION GUARD

TECHNICAL FIELD

This invention relates generally to a personal protector and more specifically to a personal protector or protection guard for a portion of the human body.

BACKGROUND OF THE INVENTION

Workers and sports players oftentimes wear personal protection pads or guards to protect themselves from harm. These guards may include shoulder pads, knee pads, elbow pads, shin pads, or the like.

As an example, a common guard used in sports is the shin guard that is designed to overlay the shin portion of a player's leg. The shin guard includes a hard, outer shell and layer of padding positioned between the outer shell and the player's leg. The shin guard is held in place by elastic straps that are coupled to the shell and wrap about the person's lower leg. Shin guards may also be incorporated into a front pocket formed in a pair of long socks or tubes configured to be worn on the lower leg.

While the shin guard provides protection to the player's leg, sometimes the shin guard slides down the person's leg and out of position when that person is running. Thus, the shin guard can become a distraction, as the player must pause to reposition the shin guard in its proper position upon the leg.

Accordingly, it is seen that a need remains for a guard to protect a portion of a person, that remains in place, and does not interfere with the movement of the person's extremities. It is to the provision of such therefore that the present invention is primarily directed.

SUMMARY OF THE INVENTION

A personal protection guard comprises a rigid shell configured for defining a recess for receiving a protectable portion of a player, a resilient force-absorbing pad coupled to the rigid shell and positioned within the recess to the rigid shell, a fastening layer overlying at least a portion of the pad and oppositely disposed from the rigid shell, and a mounting strip having a first side with an adhesive layer for adhering to the protectable portion of a player and a second side oppositely disposed from the first side having an engaging member releasably couplable to the fastening layer for detachably receiving the rigid shell by engagement of the engaging members to the fastening layer. With this construction, the personal protection guard is detachably attached to the protectable portion of the player to resist force impacts during sports play and resist dislodgement during use.

In another aspect, the present invention provides a personal protection guard, comprising a guard portion having an exterior shell, a resilient pad mounted to the exterior shell, and a first releasable fastening layer mounted to the resilient pad oppositely disposed from the exterior shell, and a mounting portion separate and apart from the guard portion, the mounting portion being releasably coupled to the guard portion, the mounting portion having a second releasable fastening layer releasably couplable to the first releasable fastening layer, and an adhesive layer coupled to the second releasable fastening layer, whereby the guard portion may be separated from the mounting portion.

In yet another aspect, the present invention provides a personal protection guard, comprising an exterior protective layer; a resilient pad mounted to the exterior protective layer; a mounting strip separate and apart from the exterior protective layer and the resilient pad, the mounting strip having an adhesive layer for releasably mounting the mounting strip to a person's skin, and a fastener releasably coupling the mounting strip to the resilient pad.

Objects, advantages, and features of the present invention of will be readily apparent upon a reading of the following detailed description in conjunction with the drawings

DETAILED DESCRIPTION

Figure 1:
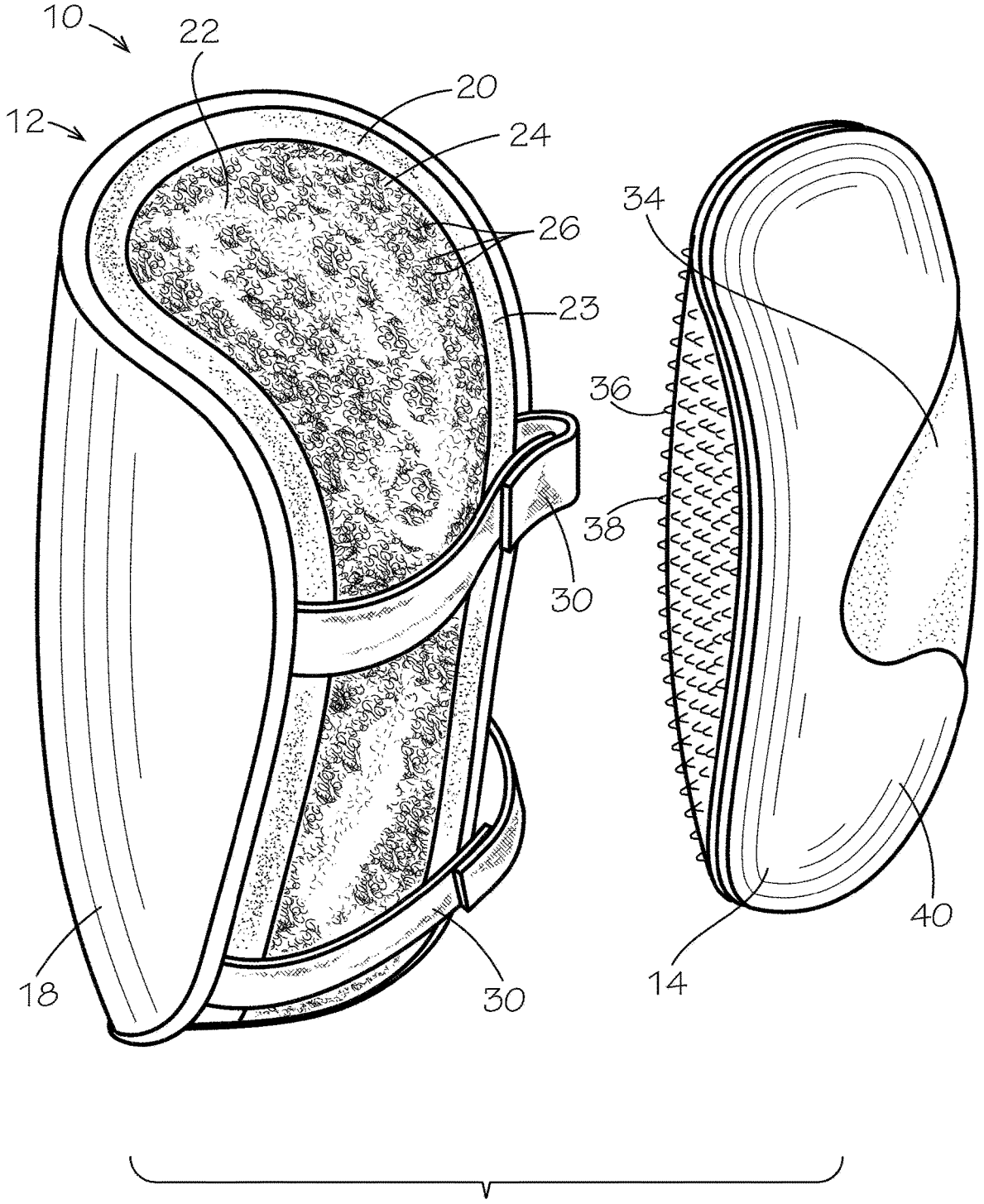
FIG. 1 illustrates a perspective view of a personal protection guard embodying principles of the invention in a preferred form.
Figure 2:
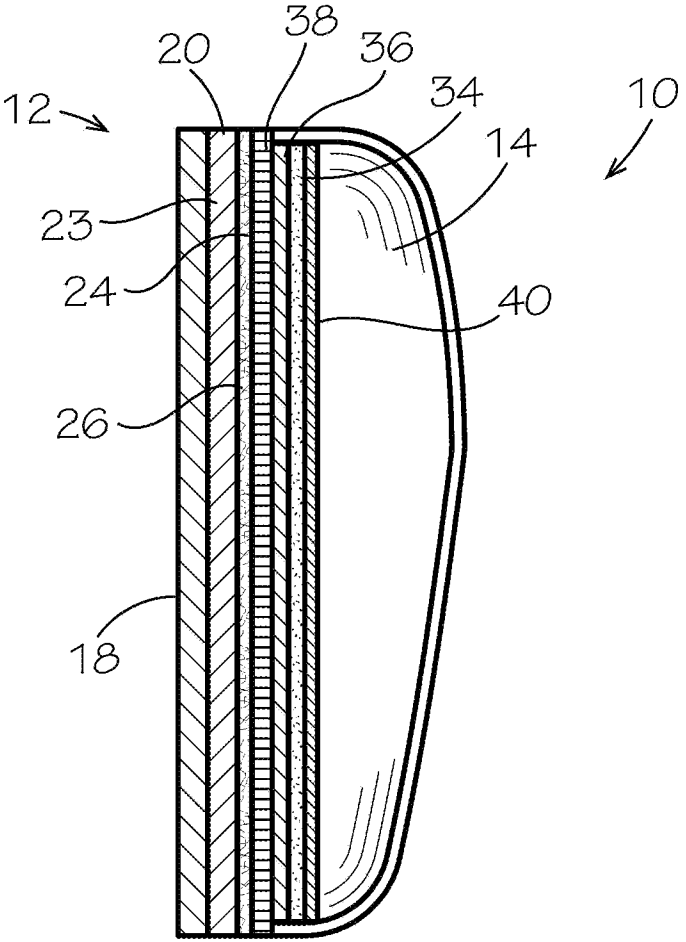
FIG. 2 illustrates a cross-sectional side view the personal protection guard shown in FIG. 1.

With reference next to the drawings, FIG. 1 illustrates in perspective view a personal protection guard 10, shown herein in the form of a shin guard, embodying principles of the invention in a preferred form. The personal protection guard 10 includes a guard portion 12 and a flexible and stretchable mounting portion or strip 14 that is separate and apart from and removably coupled to the guard portion 12. FIG. 2 illustrates a cross-sectional side view the personal protection guard 10.

With reference to both FIGS. 1 and 2, the guard portion 12 has a hard or rigid, exterior, outer casing, protective layer or shell 18 and resilient, interior or inner layer, pad, or padding 20 configured to form a recess 22 that is occupied by the protectable portion of a player, here a person's leg. The inner pad 20 includes a padding layer 23 and an exterior facing binding or fastening layer 24 having a mass of fastening loops 26 of a hook and loop type fastener. Alternatively, the mass of fastening loops may be a fabric or felt material that is configured to mesh or cooperate with corresponding hooks.

The guard portion 12 also optionally includes a pair of flexible, elastic mounting straps 30 that are sized and shaped to extend from one side of the front shell 18, wrap about a person's leg in the general area of the person's shin and calf, and be coupled to the opposite side of the front shell 18. The straps 30 include conventional connecting members such as opposing clips, buckles, or mating hook and loop fastener patches for adjustably fitting the guard to the leg.

The front shell 18 is made of a hard or generally rigid material, such as a high impact plastic. The padding layer 23 of the inner pad 20 may be made of a resilient, low density foam material, such as a cross linked polyurethane material.

The mounting strip 14 has a first, adhesive or adhesive strip layer 34 and a second, engaging, hook layer 36 of a hook and loop type fastener. The hook layer 36 has a series, mass, or matrix of hooks 38 that are configured to mesh or engage the fastening loops 26 of the fastening layer 24 of the inner pad 20. The adhesive strip layer 34 includes a removable release paper or layer 40 that when removed exposes the adhesive substance upon the adhesive strip layer 34.

The adhesive strip layer 34 may be a kinesiology tape or KT material that is thin with stretchy or elastic properties for flexing over a range of motions while affixed to the skin. The material may be porous to facilitate drying of moisture such as sweat. The adhesive provides a tacky engagement for holding of the guard 10 to a person's skin during use, but may be readily detachable after use, and the adhesive may be a hypoallergenic adhesive.

In use, the release layer 40 of the mounting strip 14 is removed from the remaining portion of the adhesive strip layer 34 to expose the adhesive on the adhesive strip layer 34. The mounting strip 14 is then pushed against the skin of the person, in this example the skin of the shin in the position that the personal protection guard 10 is intended to be placed. As such, the mounting strip 14 is coupled to the person's leg with the hooks 38 of the hook layer 36 face outwardly in a direction away from the person's shin.

Next, the person positions the guard portion 12 over and in register with the mounting strip 14 so that the hooks 38 of the hook layer 36 engage or mesh with the loops 26 of the fastening layer 24 of the guard portion 12. As such, the person's leg resides within the recess 22 defined by the inner pad 20 of the guard portion 12. With the personal protection guard 10 in a normal position upon the front of the person's leg, the personal protection guard 10 covers the shin of the wearer.

An embodiment may optionally include straps 30 that are then wrapped about the leg and secured together and to the front shell 18. The straps 30 provide additional support of the guard portion 12 to the mounting strip 14 and the position of the personal protection guard 10 upon the person. The tension of the mounting strap 30 may be varied through its positional mounting. However, it should be understood that the mounting straps 30 are merely an option and are not required as the hook and loop configuration is intended to provide the required binding or holding support to maintain the position of the personal protection guard 10 to a person's leg.

As the person moves about, the mounting strip 14 flexes or stretches to provide the underlying skin with the ability to move during such activity.

Figure 3:
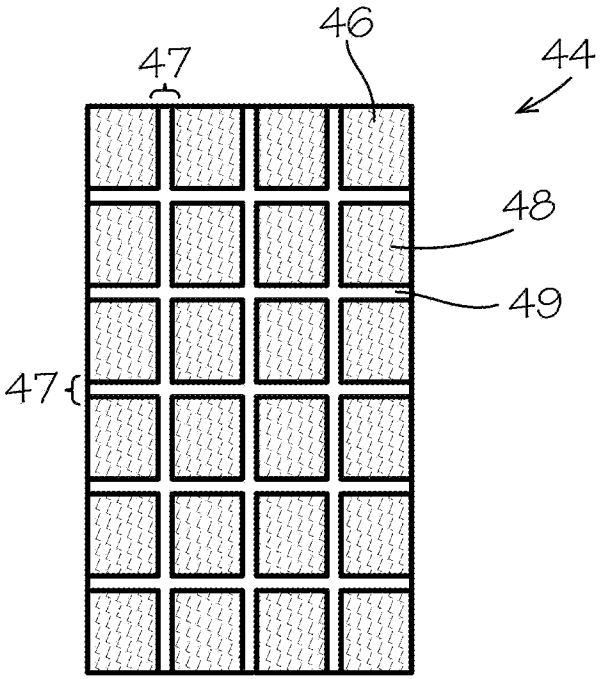
FIG. 3 illustrates in front view a mounting strip of the personal protection guard shown in FIG. 1, shown in an alternative form.

With reference next to FIG. 3, there is a shown a mounting strip 44 of the personal protection guard 10 in another form. Here, the mounting strip 44 comprises of a series of columns or rows 46 of segments 48 each with a plurality of hooks 38. The segments 48 may be spaced apart with gaps 47. The terms columns and rows may be used interchangeably herein. Each column 46 may include more than one segment 48, and therefore the arrangement may be considered to be a matrix of segments 48 having multiple rows and columns separated by the gap or space 47. Each row 46 or segment 48 may be coupled together with an additional joining layer 49 that flexibly binds the segments 48 together for articulated movement of the rows or segments. For example, the joining layer may be an adhesive-surfaced kinesiology tape. This configuration provides additional flexibility and contourability of the mounting strip 14 to the person's extremities to which the mounting strip is mounted.

It should be understood that as an alternative, the adhesive substance may be applied directly to an opposing surface of the hook layer 36. Therefore, the adhesive layer 34 may be a layer of adhesive without any type of backing or supporting material.

Figure 4:
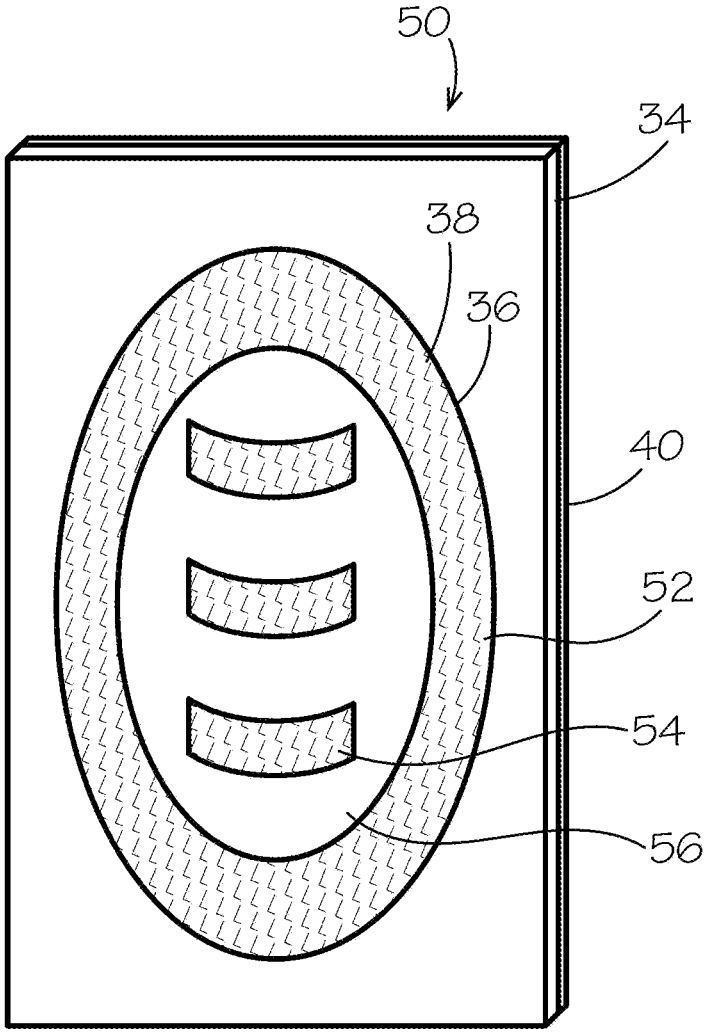
FIG. 4 illustrates in top plan view an alternate embodiment of the mounting portion of the personal protection guard shown in FIG. 1.

FIG. 4 illustrates in top plan view a mounting portion 50 as an alternate embodiment for use with the personal protection guard 10 shown in FIG. 1. The mounting portion 50 includes the hooks 38 projecting from the hook layer 36, and the opposing side includes the adhesive layer 34. The adhesive layer 34 engages the release layer 40.

The mounting portion 50 has a plurality of separate and distinct engaging member portions. In the illustrated embodiment, the mounting portion 50 is shown in the form of a perimeter band 52 and three transverse intermediate support patches 54 spaced apart inwardly of the perimeter band 52. The perimeter band 52 is of a generally consistent width or a differing width in the anatomic shape of the portion of the body to which the guard is attached. One or more of the transverse intermediate support patches 54 are illustrated positioned spaced apart in an interior space 56 relative to the band 52. The patches 54 may be joined to the band 52 or be separated from the band 52 for individual attachment to the skin. The adhesive layer 34 detaches from the release layer 40 and attaches to the skin. In the illustrated embodiment for use on a shin, the mounting portion 50 includes a perimeter band 52 that is oval in shape with the plurality of support patches 54 that are arcuate in shape. A portion of the adhesive layer 34 opposite the support patches 54 attaches to the player's shin below the knee and the curved side portions of the band 52 attach on opposing side or lateral portions of the shin.

The guard portion 12 detachably registers with the mounting portion 50 attached to the shin. The hooks 38 of the band 52 and support patches 54 engage the fastening layer 24 of the guard portion 12 for impact resistance during wearing use of the personal protection guard 10 while engaged in a sporting activity.

It should be understood that other types of releasable fasteners may be utilized as an alternative to the hood and loop type fasteners described herein. For example, the releasable fastener may be a layer of releasable adhesive, snaps, a tongue and groove mounting arrangement, or other similar means.

It is to be appreciated that a plurality of the mounting strips 14 or of the alternative embodiment mounting portion 50 may be provided as a package for single use of each with the rigid guard portion 12 and disposal of the mounting strip or portions after use.

As such, a personal protection guard comprises a rigid shell configured for defining a recess for receiving a protectable portion of a player, a resilient force-absorbing pad coupled to the rigid shell and positioned within the recess to the rigid shell, a fastening layer overlying at least a portion of the pad oppositely disposed from the rigid shell, and a mounting strip having a first side with an adhesive layer for adhering to the protectable portion of a player and a second side oppositely disposed from the first side having an engaging member releasably couplable to the fastening layer for detachably receiving the rigid shell by engagement of the engaging members to the fastening layer. With this construction, the personal protection guard is detachably attached to the protectable portion of the player to resists force impacts during sports play and resists dislodgement during use.

It thus is seen that a personal protection guard is now provided that allows for comfort while protecting the extremities of a person. Although the personal protection guard has been illustrated and described in its preferred form, it should be understood that many modifications, additions and deletions may be made to that specific form without departure from the spirit and scope of the invention as set forth in the claims.

What is claimed is:

1. A personal protection guard, comprising:

a rigid shell configured for defining a recess for receiving a protectable portion of a player;

a resilient force-absorbing pad coupled to the rigid shell and positioned within the recess of the rigid shell;

a fastening layer oppositely disposed from the rigid shell; and a mounting strip having a first side with an adhesive layer for adhering to the protectable portion of a player and a second side oppositely disposed from the first side having an engaging member releasably couplable to the fastening layer, characterized in that the mounting strip is sized and shaped so that, when coupled to the fastening layer, a perimeter of the mounting strip lies in register with a perimeter of the rigid shell for detachably receiving the rigid shell by engagement of the engaging member to the fastening layer, whereby the personal protection guard is detachably attachable to the protectable portion of the player for resisting force impacts during sports play and dislodgement during use.

2. The personal protection guard of claim 1 wherein the fastening layer is a first portion of a hook and loop type fastener and wherein the engaging member is a second portion of the hook and loop type fastener cooperating with the first portion of the hook and loop type fastener.

3. The personal protection guard of claim 1 further comprising at least one flexible mounting strap coupled to the rigid shell.

4. The personal protection guard of claim 1 wherein the engaging member has fasteners that are configured to conform to the anatomic configuration of the protectable portion of a player.

5. The personal protection guard of claim 1 wherein the engaging member is configured as an oval band.

6. The personal protection guard of claim 5 wherein the engaging member also includes at least one support patch positioned within the oval band.

7. The personal protection guard of claim 1 wherein the engaging member has a plurality of separate and distinct engaging member portions.

8. The personal protection guard of claim 1 wherein the engaging member comprises a series of rows.

9. The personal protection guard of claim 8 wherein each row of said series of rows has a series of segments of engaging members.

10. A personal protection guard, comprising:

a guard portion having an exterior shell, a resilient pad mounted to the exterior shell, and a first releasable fastening layer mounted to the resilient pad oppositely disposed from the exterior shell, and a mounting portion separate and apart from the guard portion, the mounting portion for being releasably coupled to the guard portion with a perimeter of the mounting portion lying in register with a perimeter of the exterior shell, the mounting portion having a second releasable fastening layer for being releasably couplable to the first releasable fastening layer, and an adhesive layer for releasably adhering to a protectable portion of a player, whereby the guard portion is selectively separable from the mounting portion.

11. The personal protection guard of claim 10 wherein the first releasable fastening layer is a first portion of a hook and loop type fastener and wherein the second releasable fastening layer is a second portion of the hook and loop type fastener cooperating with the first portion of the hook and loop type fastener.

12. The personal protection guard of claim 10 further comprising at least one flexible mounting strap coupled to the exterior shell.

13. The personal protection guard of claim 10 wherein the second releasable fastening layer has fasteners that are configured to conform to the anatomic configuration of the protectable portion of a player.

14. The personal protection guard of claim 10 wherein the second releasable fastening layer is configured in the shape of an oval band.

15. The personal protection guard of claim 14 wherein the second releasable fastening layer also includes at least one support patch positioned within the oval band.

16. The personal protection guard of claim 10 wherein the second releasable fastening layer has a plurality of separate and distinct engaging member portions.

17. A personal protection guard, comprising:

an exterior protective layer;

a resilient pad mounted to the exterior protective layer;

a mounting strip separate and apart from the exterior protective layer and the resilient pad, the mounting strip having an adhesive layer for releasably mounting the mounting strip to a person's skin and sized and shaped for a perimeter to register with a perimeter of the exterior protective layer; and a fastener releasably coupling the mounting strip to the resilient pad.

18. The personal protection guard of claim 17 wherein the fastener comprises a first releasable fastening layer mounted to the resilient pad oppositely disposed from the exterior protective layer, and a second releasable fastening layer coupled to the mounting strip, the first releasable fastening layer being releasably coupled to the second releasable fastening layer.

19. The personal protection guard of claim 18 wherein the first releasable fastening layer is a first portion of a hook and loop type fastener and wherein the second releasable fastening layer is a second portion of the hook and loop type fastener cooperating with the first portion of the hook and loop type fastener.

20. The personal protection guard of claim 17 further comprising at least one flexible mounting strap coupled to the exterior protective layer.

21. The personal protection guard of claim 18 wherein the second releasable fastening layer has fasteners that are configured to conform to the anatomic configuration of the protectable portion of a player.

22. The personal protection guard of claim 18 wherein the second releasable fastening layer is configured in the shape of an oval band.

23. The personal protection guard of claim 22 wherein the second releasable fastening layer also includes at least one support patch positioned within the oval band.

24. The personal protection guard of claim 18 wherein the second releasable fastening layer has a plurality of separate and distinct engaging member portions.

* * * * *